US006185774B1

(12) United States Patent
Tubman

(10) Patent No.: US 6,185,774 B1
(45) Date of Patent: Feb. 13, 2001

(54) RECIRCULATION SPRAY NOZZLE FOR A VERTICAL AXIS WASHER

(75) Inventor: Casey J. Tubman, St. Joseph, MI (US)

(73) Assignee: Whirlpool Corporation, Benton Harbor, MI (US)

( * ) Notice: Under 35 U.S.C. 154(b), the term of this patent shall be extended for 0 days.

(21) Appl. No.: 09/333,555

(22) Filed: Jun. 16, 1999

(51) Int. Cl.[7] ..... D06F 39/08
(52) U.S. Cl. ..... 8/158; 68/207
(58) Field of Search ..... 8/158; 68/23.5, 68/207

(56) References Cited

U.S. PATENT DOCUMENTS

| | | | | |
|---|---|---|---|---|
| 3,304,751 | * | 2/1967 | Mueller et al. | 68/23.5 |
| 3,566,906 | | 3/1971 | Beare | 137/216 |
| 3,605,455 | | 9/1971 | Olthuis | 68/207 |
| 4,000,968 | | 1/1977 | Schrage et al. | 8/158 |
| 4,303,406 | | 12/1981 | Ross | 8/158 |
| 4,754,622 | | 7/1988 | Fanson | 68/207 |
| 5,031,426 | | 7/1991 | Wilson | 68/207 |
| 5,167,722 | * | 12/1992 | Pastryk et al. | 68/23.5 X |
| 5,582,039 | * | 2/1967 | Mueller et al. | 68/207 X |

* cited by examiner

*Primary Examiner*—Philip R. Coe
(74) *Attorney, Agent, or Firm*—Thomas J. Roth; Robert O. Rice; Joel M. Van Winkle

(57) ABSTRACT

A wash liquid inlet nozzle is provided for directing wash liquid against a bottom wall and a side wall of a vertical axis basket of an automatic washer. The inlet nozzle has a body with a rear wall, a front wall and a top wall connecting the rear wall and front wall. An inlet passage extends through the rear wall for directing a flow of wash liquid into the inlet nozzle. The front wall is arranged and configured in a first area to direct wash liquid against the basket bottom wall and a lower region of the basket side wall and in a second area to direct wash liquid against a middle and an upper region of the basket side wall. With such an inlet nozzle, wash liquid is directed in a sheet against the entire height of the basket wall to wet all of the clothes in the basket.

23 Claims, 6 Drawing Sheets

FIG. 4
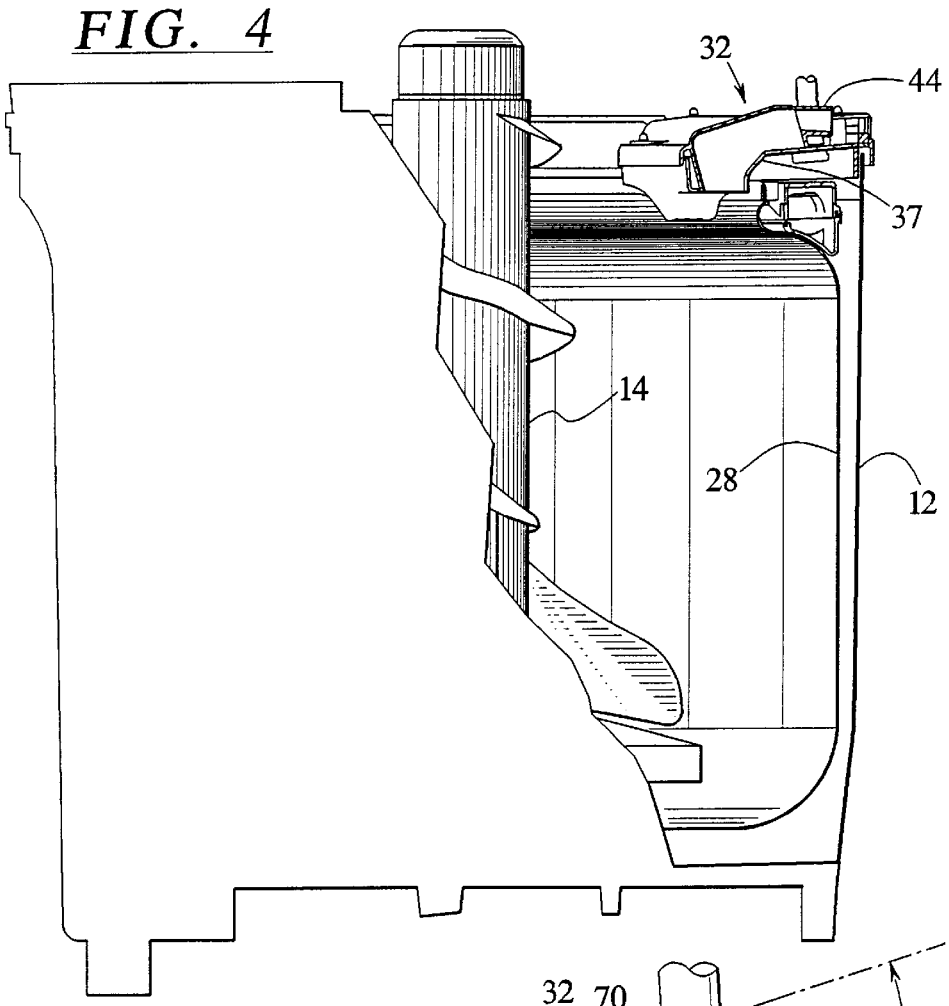
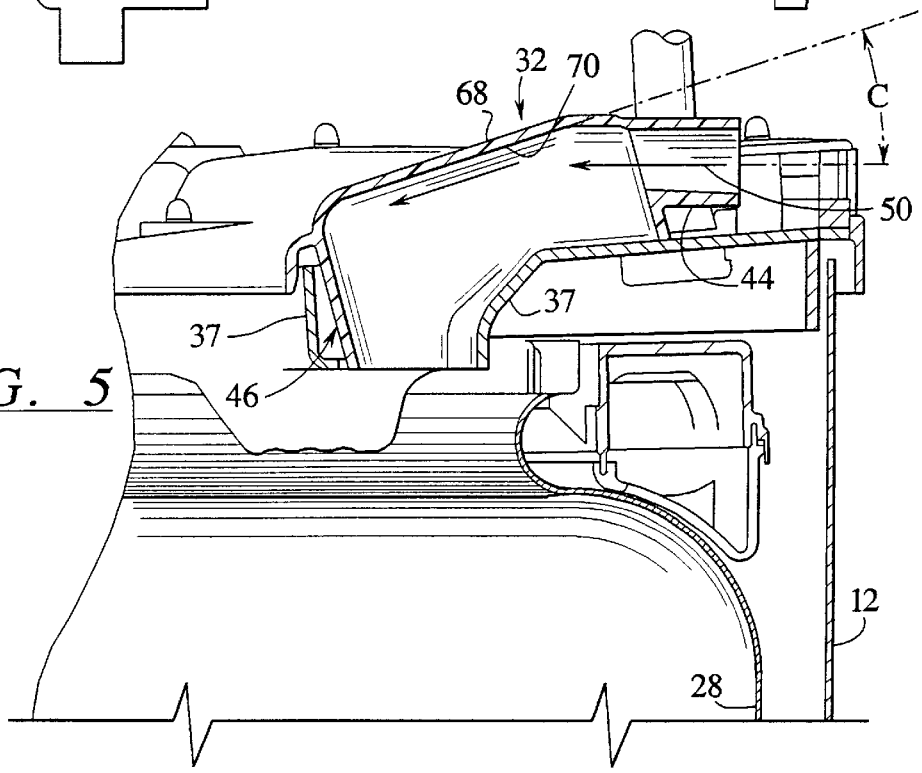
FIG. 5

RECIRCULATION SPRAY NOZZLE FOR A VERTICAL AXIS WASHER

BACKGROUND OF THE INVENTION

The present invention relates to a water inlet device for an automatic washer and more particularly to a water inlet device for directing water against various portions of the baskets sidewall.

Water inlet devices are used to provide a vacuum break in the inlet line and to dispense water from an inlet conduit into the basket of the washing machine onto a clothes load which is located in the bottom or along the sidewall of the basket. Various configurations of water inlets have been proposed for providing an inlet water flow directed toward various portions of the interior of the wash basket including the basket wall, directly upon the clothes or directed toward the agitator.

For example, U.S. Pat. No. 4,000,968 discloses an inlet device which directs incoming wash fluid toward the central vertical agitator which then causes a re-directed spray onto the clothes. U.S. Pat. No. 3,304,751 discloses an inlet device having two separate outlet openings, one directing spray toward the agitator and a second directing spray toward the basket wall.

U.S. Pat. No. 4,303,406 discloses various inlet arrangements for dispensing water throughout a range of locations within the basket.

U.S. Pat. No. 4,754,622 discloses an inlet device which provides a flow of water against an interior surface of a wash basket and onto a clothes load within the basket through a wide range of inlet water pressures while preventing excessive splashing against the basket wall at high water pressures. The inlet device has a downwardly angled front wall which redirects the inlet water into the wash basket, and the wall has a varying downward angle along its length to provide the automatic pressure compensation.

SUMMARY OF THE INVENTION

The present invention provides a water inlet nozzle arranged and configured within its mounting on a tub ring to allow a dry or wet clothes load to be sprayed at any height in the basket. Recirculating water and wash liquid can be directed through the nozzle to direct the liquid uniformly onto clothes within the basket, no matter their height in the basket.

The nozzle is formed as a part of the tub ring and is arranged near the backside of the basket. The nozzle has a front edge formed of two linear segments angled relative to one another and joined by a generous radius.

The nozzle is positioned to one side of a front to back centerline of the wash basket and the lateralmost segment of the front edge is arranged perpendicular to the front to back centerline, that is, parallel to the side-to-side diameter of the basket.

The centralmost segment is arranged at approximately 45° to the lateralmost segment and a gentle radius joins the two segments to prevent an abrupt change in the water path across the front edge of the nozzle. Opposite the front edge is an inlet opening for the water. The inlet opening comprises a short cylindrical passage which opens into the interior of the nozzle body. The inlet passage is arranged at an angle of approximately 15° relative to the front to rear axis. A top wall is angled downwardly and forwardly from the inlet passage at an angle of approximately 15–19° causing water which flows in through the cylindrical inlet passage to impinge upon the underside of the top wall and to fan out across the top wall toward lateral sidewalls of the nozzle. The water thus fans out toward the front edge. The front edge of the nozzle, at the lateralmost segment, is directed downwardly and rearwardly at an angle between 12 and 16° from vertical. Water striking this segment of the front edge will be directed toward the bottom of the basket wall and the agitator.

Along the centralmost segment, the wall is angled downwardly and rearwardly between 12 and 16° from vertical. This range of angles, compounded with the 45° angle relative to the lateralmost segment, provides coverage of the clothes at the top of the basket wall. The generous radius between the two front segments of the nozzle provides for continuous coverage of clothes located in the mid-section of the basket.

If the nozzle is to be used for both dry and wet loads, the front face should be proportionally longer so as to provide more water to the lower loads after being wetted down.

Thus, the present invention provides a water inlet device which provides a uniform flow of water against the interior of the tub basket along a substantial portion of the height of the sidewall of the basket.

BRIEF DESCRIPTION OF THE DRAWINGS

FIG. 4 is a partial side sectional view of the inlet device taken generally along the lines IV—IV of FIG. 3.

FIG. 5 is an enlarged view of the section shown in FIG. 4.

DESCRIPTION OF THE PREFERRED EMBODIMENTS

Figure 1:
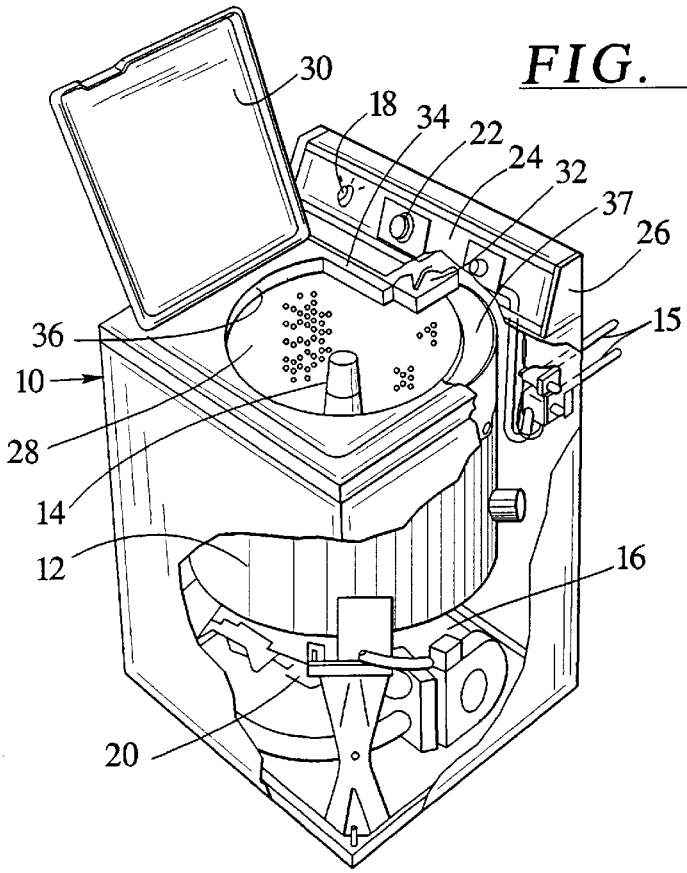
FIG. 1 is a perspective view of an automatic washer with an inlet device embodying the principles of the present invention.

In FIG. 1 a washing machine is generally shown at 10 which has a tub 12 with a vertical agitator 14 therein, a water supply 15, a power supply (not shown) an electrically driven motor 16 operably connected via a transmission 20 to the agitator 14, and controls 18 including a pre-settable sequential control device 22 for use in selectively operating the washing machine 10 through a programmed sequence of washing, rinsing and extracting steps. The control device 22 is mounted to a panel 24 of a console 26 on the washing machine 10. A rotatably and perforate basket 28 is carried within the tub 12 and is accessible through an openable top lid 30 of the washer 10.

A water inlet device 32 embodying the principles of the present invention is mounted beneath a panel 34 forming a portion of the washer cabinet which includes an opening 36 into the interior of the wash basket 28. The inlet device 32 is conveniently mounted beneath the console 26 and extends over a tub ring 37 so that a portion of the inlet device is positioned above the basket.

Figure 3:
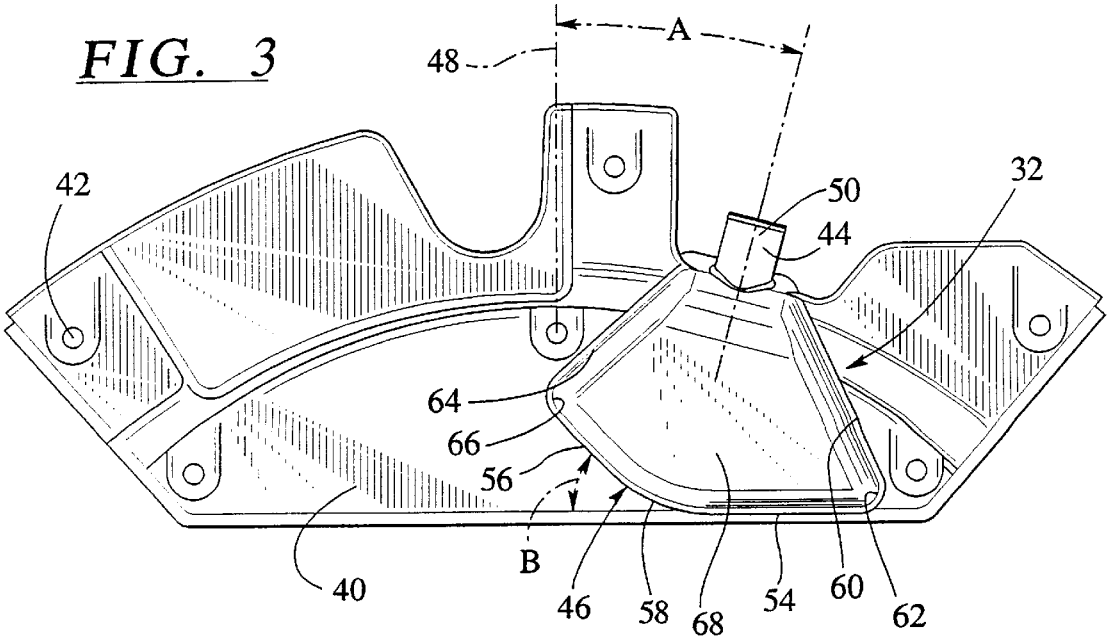
FIG. 3 is an enlarged plan view of the inlet device of FIG. 2.
Figure 2:
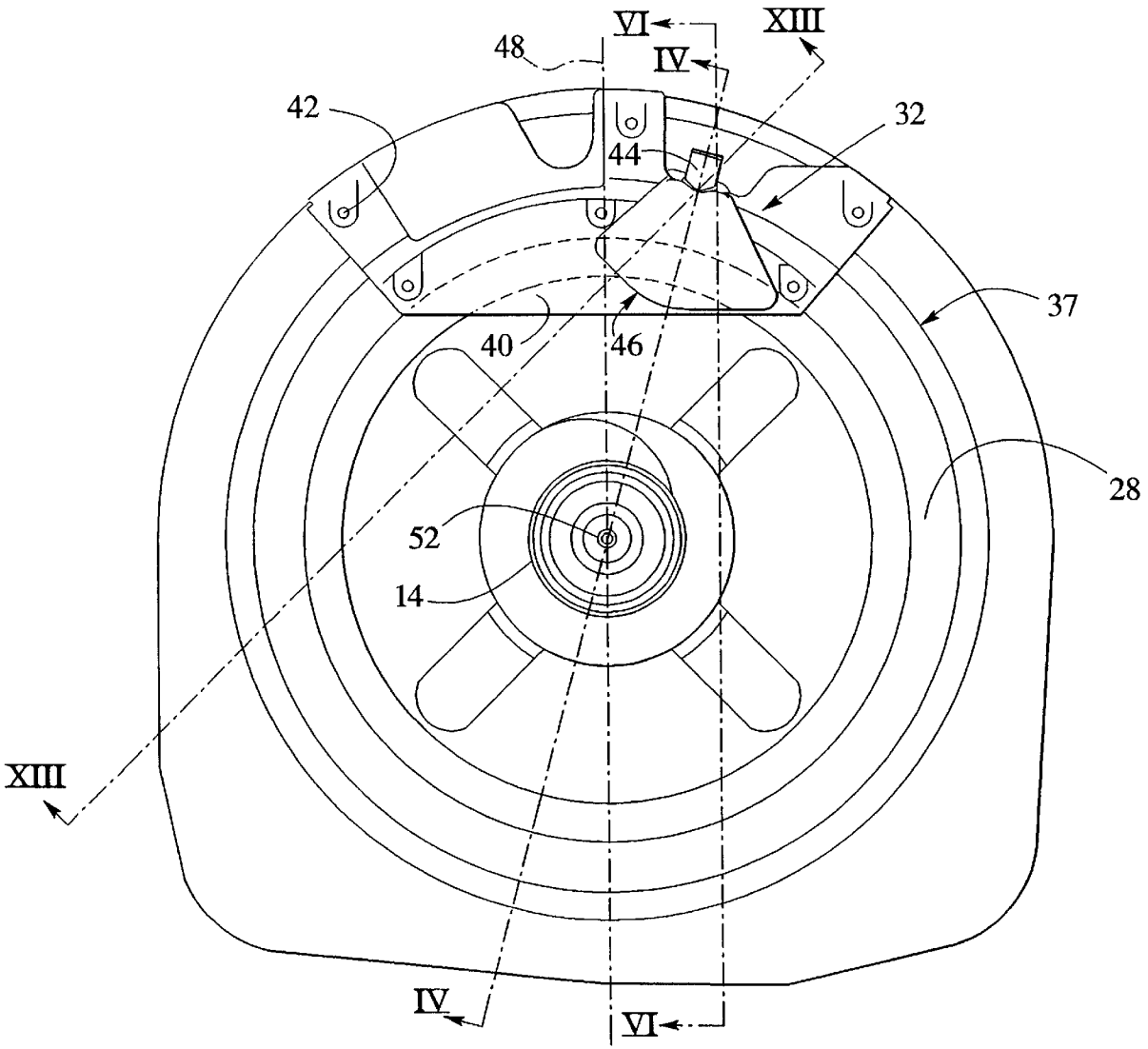
FIG. 2 is a plan view of the inlet device of the present invention in place above the wash basket.

The water inlet device 32 is shown in greater detail in FIG. 2 and in isolated detail in FIG. 3, in a plan view. Various side sectional views are shown in FIGS. 4–9.

The water inlet device 32 is formed as part of a plate member 40 which attaches by appropriate fastening means such as screws 42 to the tub ring 37 which overlies the assembled tub 12 and basket 28. The water inlet device 32 includes a cylindrical inlet passage 44 opening through a back wall 45 thereof and a front edge 46 at a forward side thereof. The nozzle 32 is mounted over a rear portion of the basket 28 and is laterally offset from a front to rear center line 48 of the washer. The inlet passage 44 has a central axis 50 which is offset from the front to rear washer axis 48 by an angle A of approximately 13 to 17°. The axis 50 of the inlet passage 44 is directed substantially toward a center 52 of the agitator 14.

The front edge 46 of the inlet device 32 has a first linear segment 54 and a second near segment 56 which are joined together by a radius segment 58. The first segment 54 is positioned laterally further from the front to rear axis 48 of the washer than the second linear segment 56 which is more centrally located. A first sidewall 60 extends from near the inlet nozzle 44 to the first segment 54 of the front edge 46 and joins it by means of a rather sharp radius section 62. A second sidewall 66 extends from near the inlet nozzle 44 to the second linear segment 56 of the front wall 46 and joins that segment by means of a rather sharp radius section 66.

The inlet device 32 also includes a top wall 68 which joins the back wall 45, sidewalls 60, 64 and front edge 46. The second linear segment 56 is positioned at a angle B of approximately 45° relative to the first linear segment 54. As best seen in FIG. 5, the top wall 68 is arranged at an angle C relative to the axis 50 of the inlet passage 44 by approximately 15 to 19°. Thus, water entering the inlet passage 44 will be directed against an underside 70 of the top wall 68 and will be caused to spread out or fan out laterally toward sidewalls 60 and 64 as the water moves forward toward the front edge 46.

Figure 6:
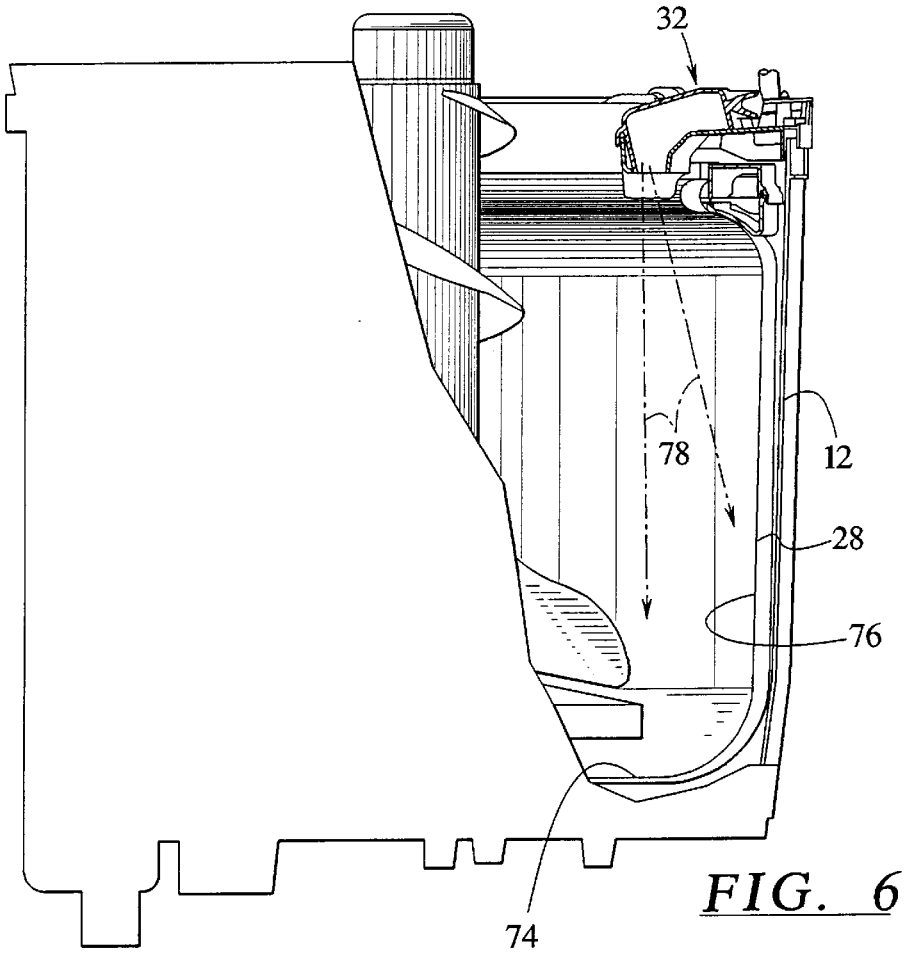
FIG. 6 is a partial side sectional view of the inlet device taken generally along the lines VI—VI of FIG. 3.
Figure 7:
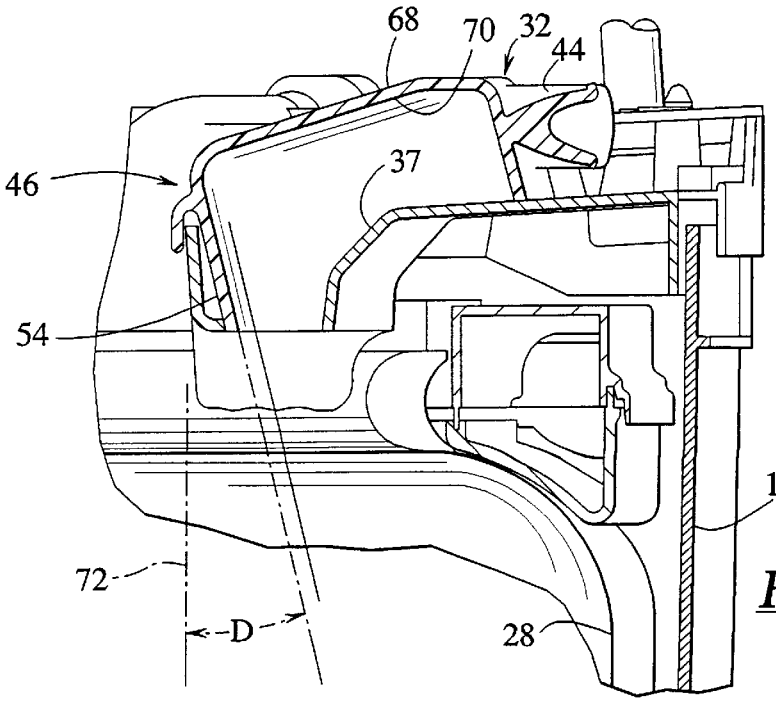
FIG. 7 is an enlarged view of the section shown in FIG. 6.

FIG. 6 is a sectional view through the washer taken along the lines VI–VI of FIG. 2 and is generally perpendicular to the first segment 54 of the front edge 46 of the inlet device 32. FIG. 7 shows an enlargement of the section of the inlet device 32 shown in FIG. 6. The first segment 54 of the front edge 46 is arranged at an angle D of approximately 12–16° from vertical, wherein vertical is designated by line 72. Thus, as shown in FIG. 6, water striking the first segment 54 of the front edge 46 will be re-directed downwardly such that the spray is directed, as shown in FIG. 6, toward a bottom 74 and a lower region 76 of the basket 28 as indicated by arrows 78. Thus, the first segment 54 of the front edge 46 will direct wash liquid onto clothes within the basket that are on the bottom 74 of the basket 28 and along the lower region 76 of the side wall of the basket 28.

Figure 8:
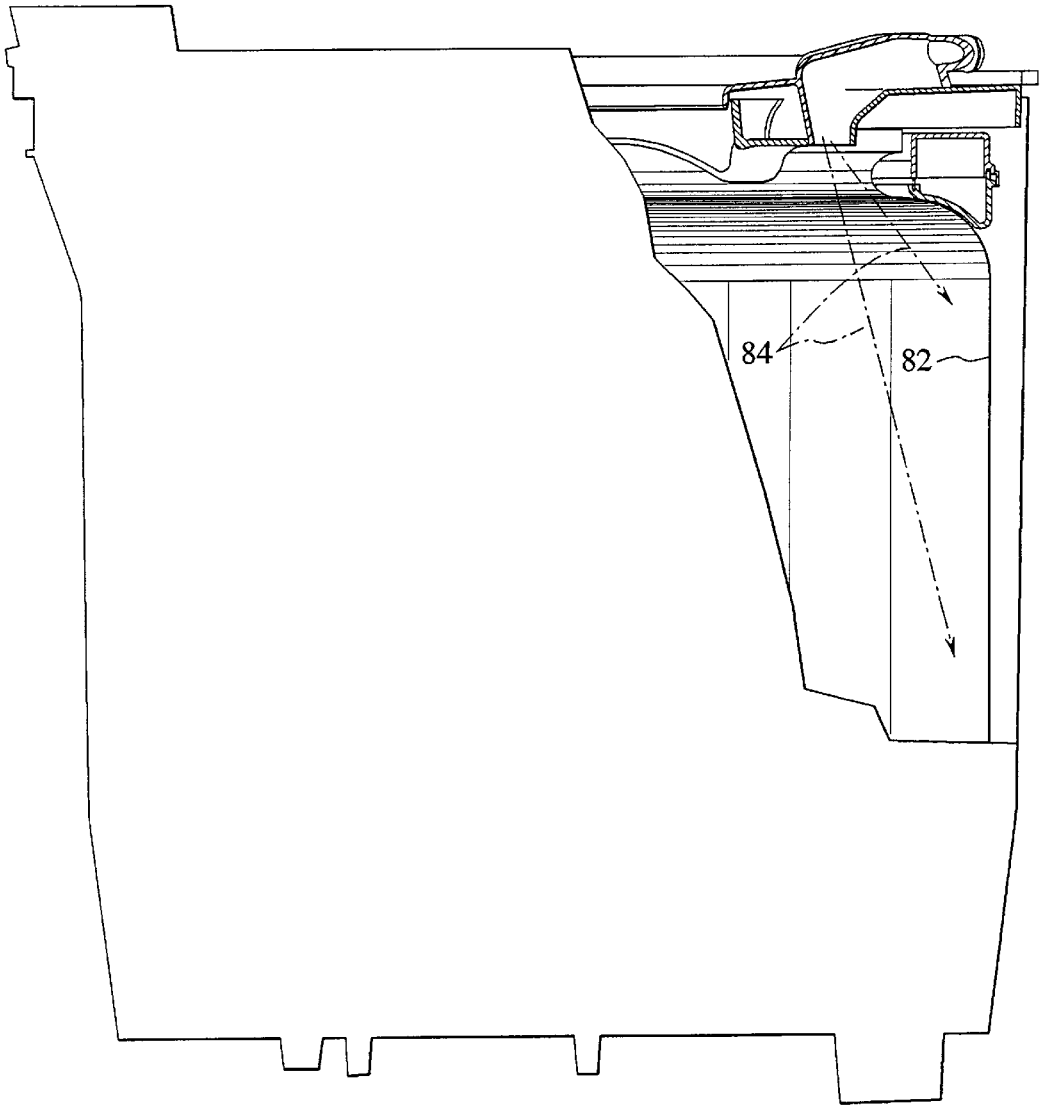
FIG. 8 is a partial sectional view of the inlet device taken generally along the lines VIII—VIII of FIG. 3.
Figure 9:
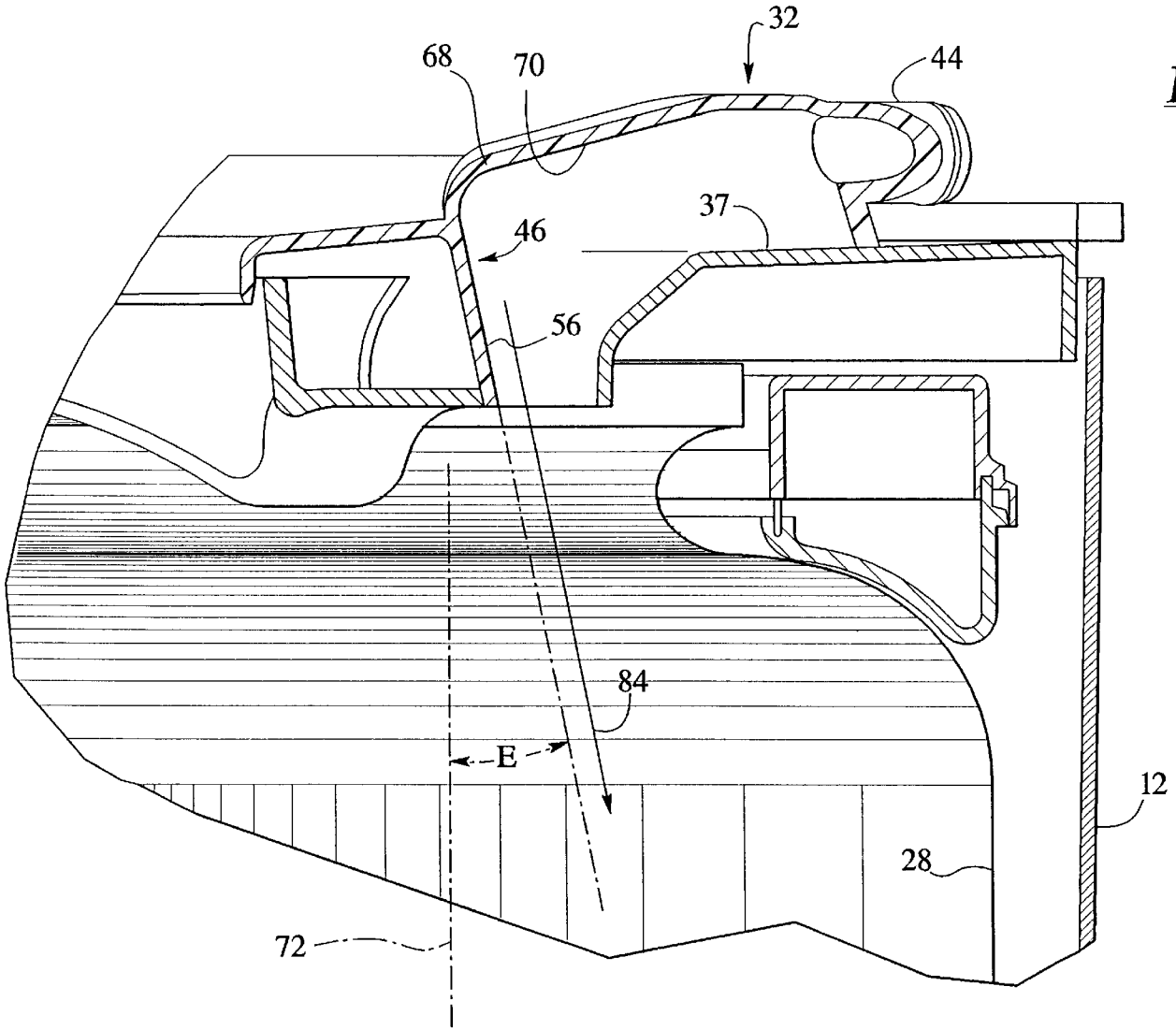
FIG. 9 is an enlarged view of the section shown in FIG. 8.

FIG. 8 is a sectional view taken along the lines VIII—VIII of FIG. 2 and is generally perpendicular to the second segment 56 of the front edge 46 of the inlet device 32. FIG. 9 shows an enlargement of the section of the inlet device 32 shown in FIG. 8. The second segment 56 of the front edge 46 is arranged at an angle E of approximately 12–16° from vertical, wherein vertical is designated by line 80. Thus, as shown in FIG. 8, water striking the second segment 56 of the front edge 46 will be redirected downwardly such that the spray is directed as shown in FIG. 8 toward a middle lower region 81 and an upper portion 82 of the basket 28 as indicated by arrows 84. Thus, the second segment 56 of the front edge 46 will direct wash liquid onto clothes within the basket that are positioned along the middle region 81 and upper region 82 of the sidewall of the basket 28.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A wash liquid inlet nozzle for directing wash liquid against a bottom wall and a side wall of a vertical axis basket of an automatic washer, said inlet nozzle comprising:

a body having a rear wall, a front wall and a top wall connecting said rear wall and front wall;

an inlet passage extending through said rear wall for directing a flow of wash liquid into said inlet nozzle;

said front wall being arranged and configured in a first area to direct wash liquid against said basket bottom wall and a lower region of said basket side wall and in a second area to direct wash liquid against a middle and an upper region of said basket side wall.

2. A wash liquid inlet nozzle according to claim 1, wherein said body includes side walls extending between said rear wall and said front wall and being connected by said top wall.

3. A wash liquid inlet nozzle according to claim 1, wherein said body has an open bottom.

4. A wash liquid inlet nozzle according to claim 1, wherein said inlet passage defines an inlet axis, said inlet axis being arranged at an angle of about 13 to 17 degrees to a front-to-rear axis of said washer.

5. A wash liquid inlet nozzle according to claim 1, wherein said inlet passage defines an inlet axis and said top wall is arranged at a downward and forward angle of approximately 15 to 19 degrees relative to said inlet axis.

6. A wash liquid inlet nozzle according to claim 1, wherein said front wall has a first linear segment, a second linear segment and a radius segment.

7. A wash liquid inlet nozzle according to claim 6, wherein said first linear segment is arranged to be perpendicular to a front-to-rear axis of said washer.

8. A wash liquid inlet nozzle according to claim 6, wherein said second linear segment is arranged at about a 45 degree angle to said first linear segment.

9. A wash liquid inlet nozzle according to claim 6, wherein said radius segment connects said first linear segment and said second linear segment.

10. A wash liquid inlet nozzle according to claim 6, wherein said body is positioned to one side of a front-to-rear axis of said washer, such that said first linear segment is positioned away from said front-to-rear axis relative to said second linear segment.

11. A wash liquid inlet nozzle according to claim 6, wherein said front wall at said first linear segment is angled downwardly and toward said basket and away from vertical at an angle of approximately 12 to 16 degrees.

12. A wash liquid inlet nozzle according to claim 6, wherein said front wall at said second linear segment is angled downwardly and toward said basket and away from vertical at an angle of approximately 12 to 16 degrees.

13. A wash liquid inlet nozzle for directing wash liquid into a vertical axis basket, having a sidewall and a bottom wall, of an automatic washer, said inlet nozzle comprising a body having a rear wall, two side walls, a front wall and a top wall connecting said rear wall, side walls and front wall, with an open bottom;

an inlet passage extending through said rear wall for directing a flow of wash liquid into said inlet nozzle;

said front wall having a first linear segment, a second linear segment and a radius segment;

said first linear segment being arranged to be perpendicular to a front-to-rear axis of said washer;

said second linear segment arranged at about a 45 degree angle to said first linear segment;

said radius segment connecting said first linear segment and said second linear segment;

said inlet passage defining an inlet axis, said inlet axis being arranged at an angle of about 13 to 17 degrees to said front-to-rear axis, said body being positioned to one side of said front-to-rear axis, such that said first linear segment is positioned away from said front-to-rear axis relative to said second linear segment;

said front wall at said first linear segment being angled downwardly and toward said basket and away from vertical at an angle of approximately 12 to 16 degrees;

said front wall at said second linear segment being angled downwardly and toward said basket and away from vertical at an angle of approximately 12 to 16 degrees:

said top wall being arranged at a downward and forward angle of approximately 15 to 19 degrees relative to said inlet axis;

whereby, said wash liquid entering said body along said inlet axis will impinge on said top wall to fan out laterally towards said side walls as it travels towards said front wall, and as it strikes said front wall, being redirected downwardly and towards said basket wall, with a first portion of said wash liquid which strikes said first linear segment being directed to a bottom of said basket and a lower region of said basket side wall, a second portion of said wash liquid which strikes said second linear segment being directed to a middle and upper region of said basket side wall, and a third portion of said wash liquid which strikes said radius segment connecting said first portion and said second portion into a continuous sheet.

14. A method for directing wash liquid against a bottom wall and a side wall of a vertical axis basket of an automatic washer, comprising the steps of:

providing a body having a rear wall, a front wall and a top wall connecting said rear wall and front wall;

providing an inlet passage extending through said rear wall for directing a flow of wash liquid into said inlet nozzle;

arranging and configuring a first segment of said front wall to direct wash liquid against said basket bottom wall and a lower region of said basket side wall;

arranging and configuring a second segment of said front wall to direct wash liquid against a middle and an upper region of said basket side wall;

directing wash liquid in through said inlet passage against said front wall, such that a portion of said wash liquid striking said first segment of said front wall will be redirected against said basket bottom wall and a lower region of said basket side wall and a portion of said wash liquid striking said second segment of said front wall will be redirected against said middle and said upper region of said basket wall.

15. A method according to claim 14, wherein said inlet passage defines an inlet axis, including the step of arranging said inlet axis at an angle of about 13 to 17 degrees to a front-to-rear axis of said washer.

16. A method according to claim 14, wherein said inlet passage defines an inlet axis, including the step of arranging said top wall at a downward and forward angle of approximately 15 to 19 degrees relative to said inlet axis.

17. A method according to claim 14, including the step of providing said front wall with a first linear segment, a second linear segment and a radius segment.

18. A method according to claim 17, including the step of arranging said first linear segment perpendicular to a front-to-rear axis of said washer.

19. A method according to claim 17, including the step of arranging said second linear segment at about a 45 degree angle to said first linear segment.

20. A method according to claim 17, including the step of connecting said first linear segment and said second linear segment with said radius segment.

21. A method according to claim 17, including the step of positioning said body to one side of a front-to-rear axis of said washer, such that said first linear segment is positioned away from said front-to-rear axis relative to said second linear segment.

22. A method according to claim 17, including the step of angling said front wall at said first linear segment downwardly and toward said basket and away from vertical at an angle of approximately 12 to 16 degrees.

23. A method according to claim 17, including the step of angling said front wall at said second linear segment downwardly and toward said basket and away from vertical at an angle of approximately 12 to 16 degrees.

* * * * *